US009044630B1

(12) United States Patent
Lampert et al.

(10) Patent No.: US 9,044,630 B1
(45) Date of Patent: Jun. 2, 2015

(54) RANGE OF MOTION MACHINE AND METHOD AND ADJUSTABLE CRANK

(75) Inventors: David L. Lampert, Monticello, IL (US); Stephen Briggs, Champaign, IL (US); Edward William Cler, Villa Grove, IL (US); Daniel David Horein, Villa Grove, IL (US); Brian P. Lilly, Urbana, IL (US); Benjamin Berton Rund, Villa Grove, IL (US)

(73) Assignee: David L. Lampert, Monticello, IL (US)

( * ) Notice: Subject to any disclaimer, the term of this patent is extended or adjusted under 35 U.S.C. 154(b) by 1000 days.

(21) Appl. No.: 13/068,589

(22) Filed: May 16, 2011

(51) Int. Cl.
*A63B 24/00* (2006.01)
*A63B 21/00* (2006.01)

(52) U.S. Cl.
CPC ..... *A63B 24/00* (2013.01); *A63B 21/00127* (2013.01)

(58) Field of Classification Search
CPC ..... A63B 24/00
USPC ..... 482/1–9, 51–62, 900–902
See application file for complete search history.

(56) References Cited

U.S. PATENT DOCUMENTS

| | | | | |
|---|---|---|---|---|
| 2,648,330 | A | 8/1953 | Clark | |
| 2,735,422 | A | 2/1956 | Jones | |
| 2,777,439 | A * | 1/1957 | Tuttle | 601/27 |
| 3,079,914 | A * | 3/1963 | Bush | 601/23 |
| 3,212,776 | A | 10/1965 | Bassler | |
| 3,213,852 | A | 10/1965 | Zent | |
| 3,713,438 | A | 1/1973 | Knutsen et al. | |
| 3,730,174 | A | 5/1973 | Madison | |
| 3,824,993 | A | 7/1974 | Grant | |
| 3,964,742 | A | 6/1976 | Carnielli | |
| 4,355,633 | A | 10/1982 | Heilbrun | |
| 4,402,502 | A | 9/1983 | Peters | |
| 4,478,213 | A | 10/1984 | Redding | |
| 4,587,960 | A | 5/1986 | Schotten | |
| 4,611,807 | A * | 9/1986 | Castillo | 482/119 |
| 4,717,146 | A | 1/1988 | Nohara | |
| 4,720,099 | A * | 1/1988 | Carlson | 482/133 |
| 4,869,494 | A | 9/1989 | Lambert | |
| 4,881,732 | A | 11/1989 | Kepiro | |
| 4,928,673 | A | 5/1990 | Heneger | |
| 4,973,046 | A | 11/1990 | Maxwell | |
| 4,976,426 | A | 12/1990 | Szabo et al. | |
| 4,993,407 | A | 2/1991 | Chen | |
| 5,027,794 | A | 7/1991 | Pyle | |
| 5,033,736 | A | 7/1991 | Hirschfeld | |
| 5,254,060 | A | 10/1993 | Bohanan | |
| 5,284,131 | A | 2/1994 | Gray | |
| 5,343,856 | A | 9/1994 | Proctor | |
| 5,860,941 | A | 1/1999 | Saringer et al. | |
| 6,447,428 | B1 | 9/2002 | McKillip | |
| 6,547,702 | B1 * | 4/2003 | Heidecke | 482/62 |
| 6,593,710 | B2 | 7/2003 | Reck | |
| 6,607,471 | B2 | 8/2003 | Reck | |
| 6,663,539 | B1 | 12/2003 | Wu | |
| 6,755,768 | B1 | 6/2004 | Garcia-Rill et al. | |
| 6,955,630 | B2 | 10/2005 | Sher | |

(Continued)

*Primary Examiner* — Glenn Richman
(74) *Attorney, Agent, or Firm* — Wood, Phillips, Katz, Clark & Mortimer

(57) ABSTRACT

A range of motion machine having two or four cranks driven directly by motors without exposed gears or chains. The speed and direction of crank rotation and the length of the crank arms may be varied with electronic controls. Crank arm length may be varied whether the crank is stationary or rotating. The cranks and motors are mounted at the top of pedestals which are adjustable in height.

22 Claims, 15 Drawing Sheets

(56) References Cited

U.S. PATENT DOCUMENTS

| | | | | |
|---|---|---|---|---|
| 7,118,515 | B2 | 10/2006 | Kassel et al. | |
| 7,303,513 | B1 * | 12/2007 | Curtiss | 482/130 |
| 7,727,125 | B2 * | 6/2010 | Day | 482/63 |
| 7,731,634 | B2 * | 6/2010 | Stewart et al. | 482/52 |
| 8,419,598 | B2 * | 4/2013 | Dyer et al. | 482/70 |
| 2002/0198080 | A1 | 12/2002 | Reck | |
| 2003/0092536 | A1 * | 5/2003 | Romanelli et al. | 482/60 |
| 2004/0067822 | A1 | 4/2004 | Sher | |
| 2005/0107221 | A1 | 5/2005 | Vohryzka | |
| 2006/0035760 | A1 | 2/2006 | Hill | |
| 2006/0247095 | A1 | 11/2006 | Rummerfield | |
| 2008/0221492 | A1 | 9/2008 | El'Chonen | |
| 2008/0312052 | A1 * | 12/2008 | Krietzman | 482/92 |
| 2009/0233767 | A1 | 9/2009 | Huang | |
| 2011/0082014 | A1 * | 4/2011 | Leonhard | 482/57 |

* cited by examiner

Fig. 4C
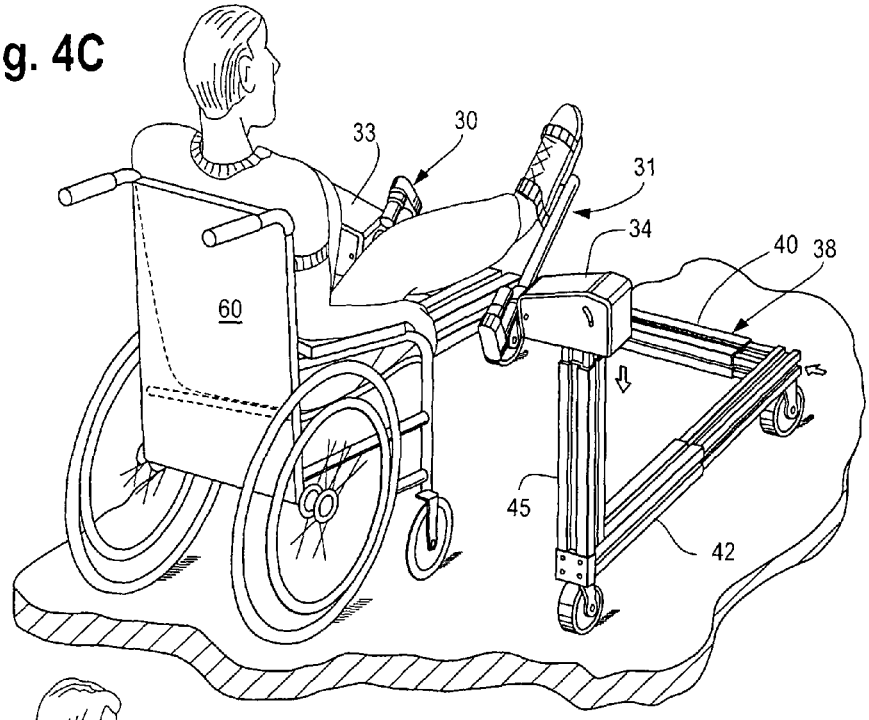
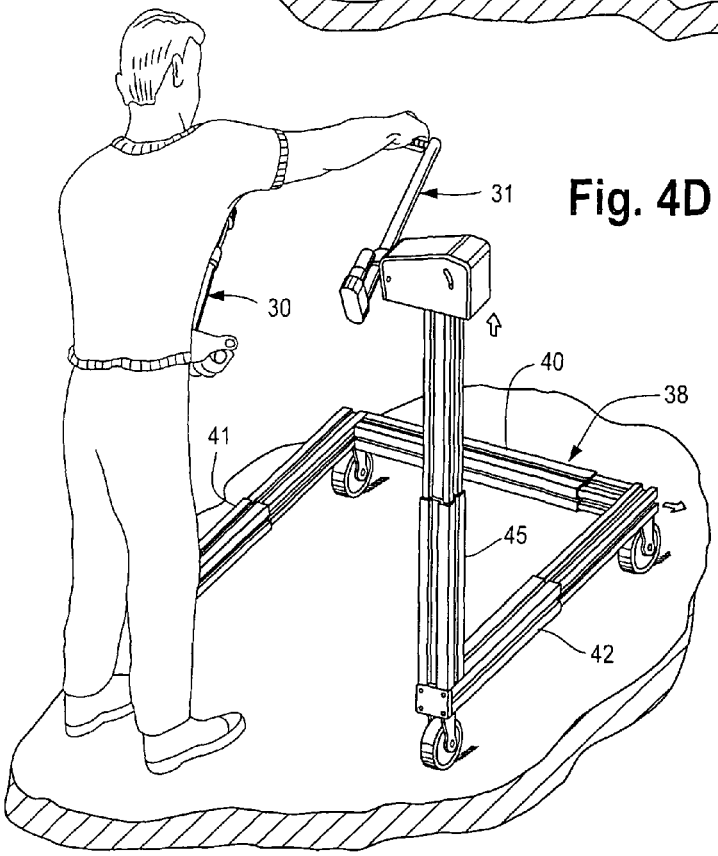
Fig. 4D 84
86

108

114
116

114
96

104
110
98
104
83
90

57
82

31
88
118
116
112
100
112
102

92

104
104
94
95
32
122
90
57

45
104
94
45

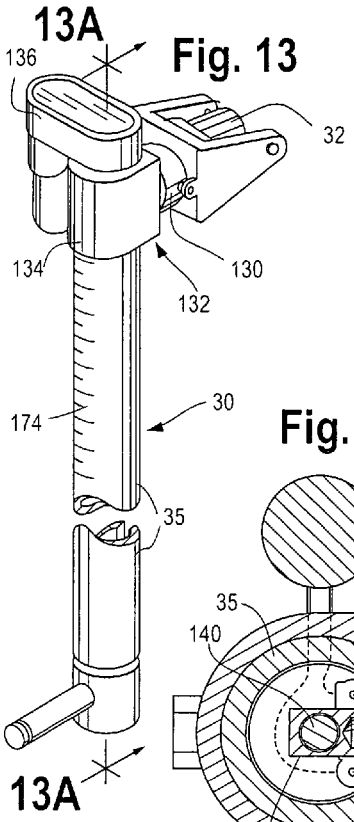
Fig. 13
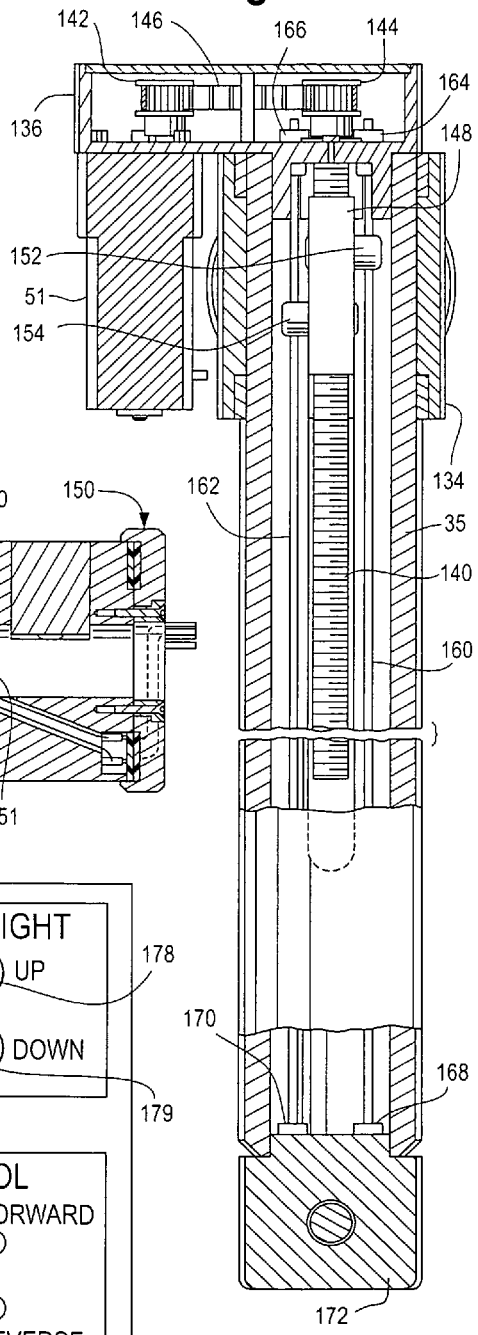
Fig. 13A
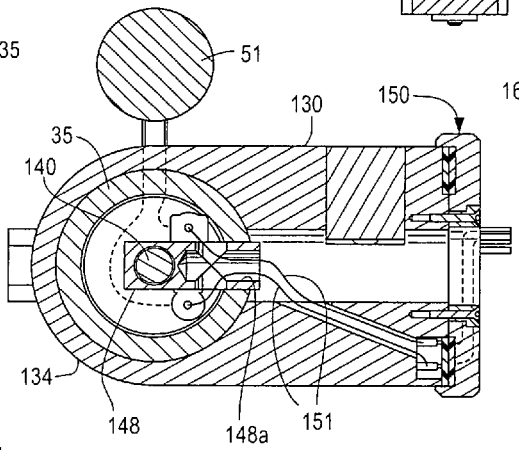
Fig. 13B
Fig. 14
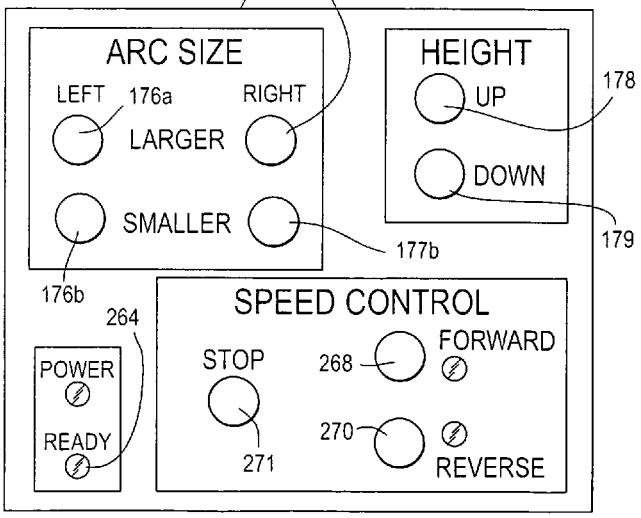

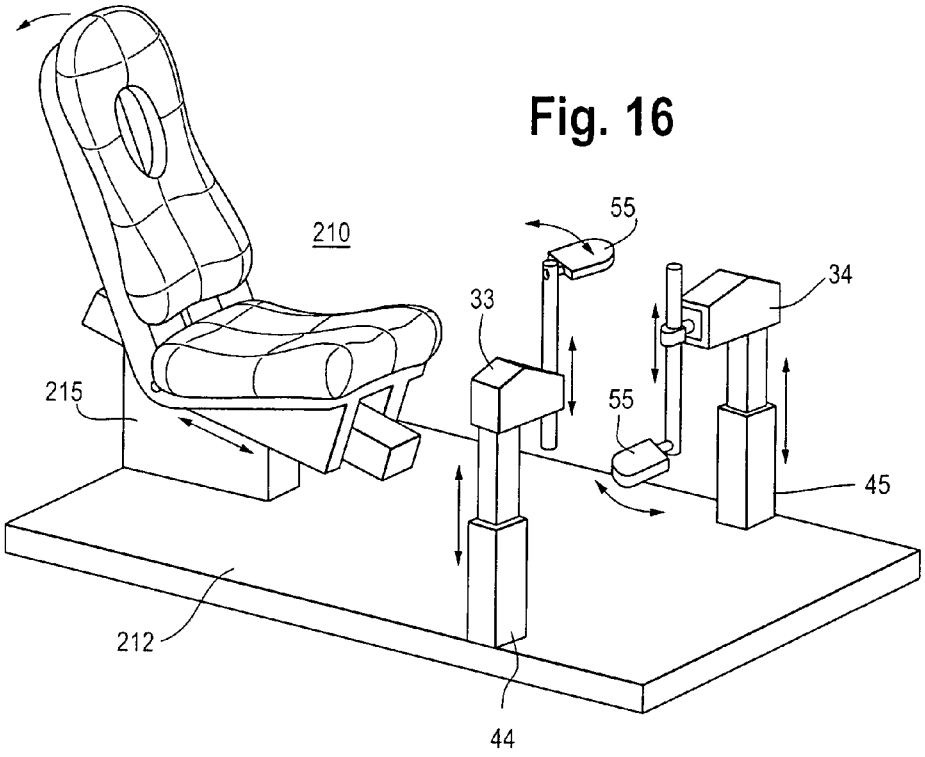
Fig. 16
Fig. 16A
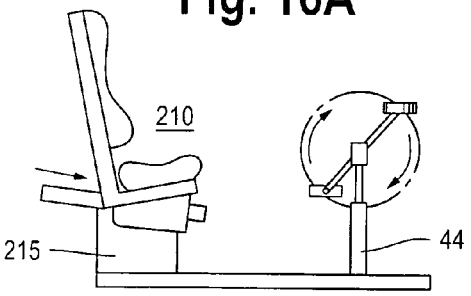
Fig. 16B
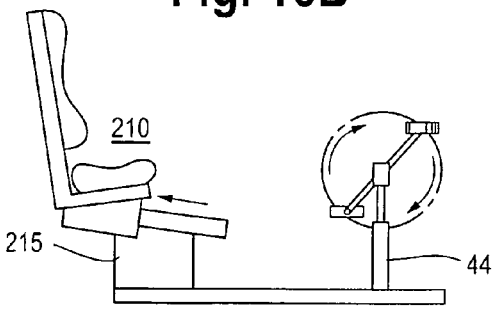

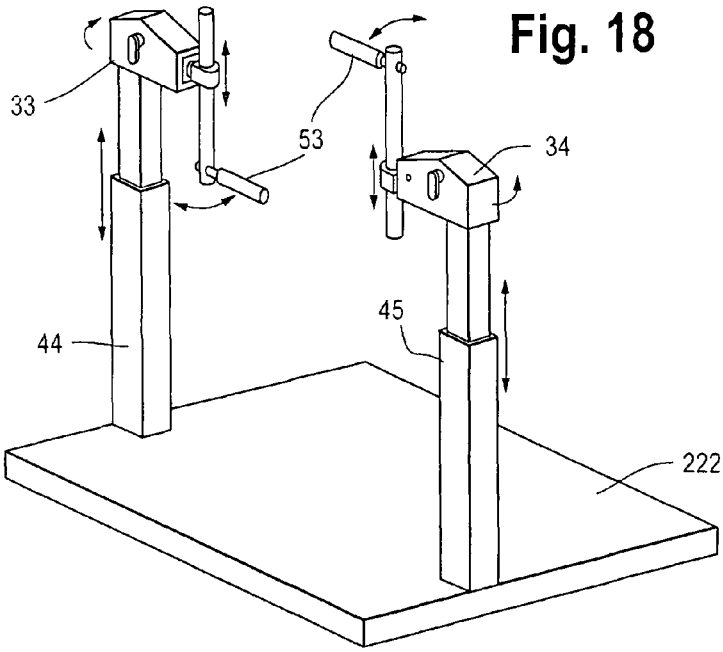
Fig. 18
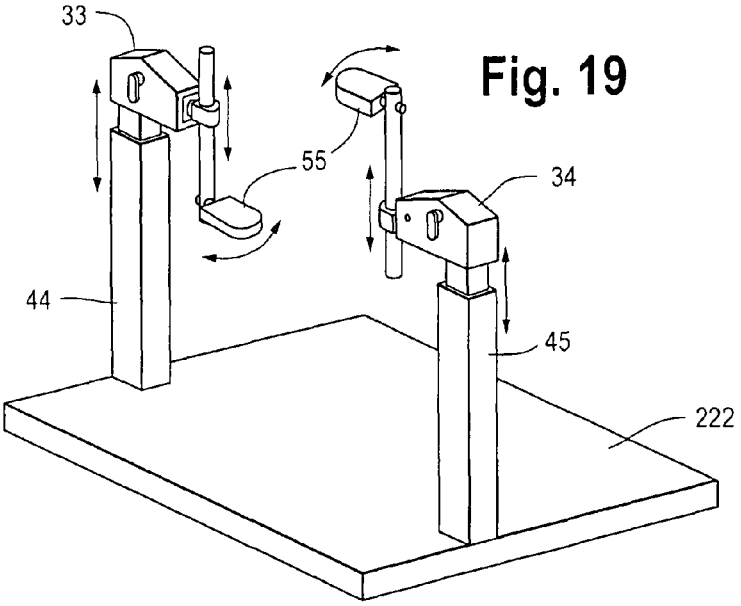
Fig. 19
Fig. 19A
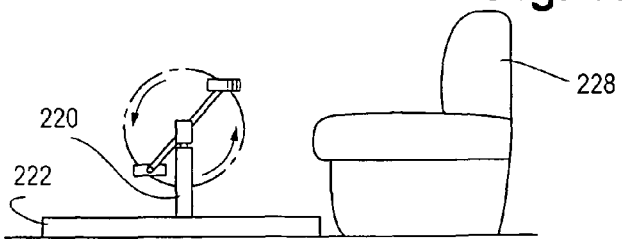

RANGE OF MOTION MACHINE AND METHOD AND ADJUSTABLE CRANK

BACKGROUND OF THE INVENTION

It is known to provide exercise machines with motor driven cranks which are engaged by hands and/or feet of the user. Such machines may be used passively, as to provide movement of the arms and/or legs of a person incapacitated in some way, or actively where the user will try to advance or retard the rotation of the cranks, building muscle. Previous machines have cranks which are fixed in length or have a manual adjustment that can be changed only when stopped, and which are connected with a drive motor through chains, belts, and/or gears that are noisy, risk injury to the user and require guards or shields.

BRIEF SUMMARY OF THE INVENTION

This invention provides a Range of Motion (ROM) machine which will increase the range of motion of the user's arms and legs in addition to affording exercise and building muscle. Several embodiments are disclosed.

A principal feature of the machine is that motor-driven cranks for exercising the arms or legs of the user through a circle of rotation have crank arms adjustable in length to change the circle size. The crank arm length may be changed whether the cranks are stopped or are rotating. Typically, a user will begin an exercise session with short crank arms rotating at a low speed. As the user's muscles are stretched and warmed, the crank arms are lengthened, making the circle of rotation larger, enhancing the user's range of motion and the speed of rotation is increased intensifying the user's exercise.

The cranks have spaced planes of rotation which define a user location between them. Each crank is rotated by a direct drive motor, without gears, chains, belts and operation is nearly silent. The crank motors are electronically controlled with 180° crank displacement, and the control provides for user selection of the direction and velocity of crank rotation and crank arm length. In a machine with two motor-driven cranks for exercising either arms or legs, the cranks are fitted with removable and interchangeable hand grips or foot pedals.

The planes of crank rotation are parallel and 90° from the lateral plane of the user's body for leg exercise as with a bicycle except the cranks are outside the body. For arm exercise, they may be done in the same plane as the feet or the user may change the plane of rotation about either a horizontal or a vertical axis. This provides arm movement similar to a swimming stroke. This movement causes the upper body to twist from side to side exercising the arms, shoulders and the entire back.

In one embodiment of the ROM machine, the motors and cranks are mounted at the top of vertical pedestals carried by a U-shaped, wheeled frame. The frame mounted machine may be used in many ways, for example, by being positioned about the end of a user's bed in a hospital or rehabilitation facility for exercise of bedridden patients and moved from patient to patient rather than moving patients to the machine. The frame-mounted machine may also serve a user seated in a chair or standing between the pedestals.

In another embodiment of the machine, suitable for a gymnasium or exercise facility, a chair for a user is mounted to tilt about a horizontal axis, between upright and supine positions. Two pairs of cranks, one for the arms and the other for the legs are mounted to move with the chair and are pivoted to afford exercise of the arms and legs at different angles. Similar embodiments combine a chair with two pedestal-mounted cranks for either arm or leg exercise.

In yet another embodiment of the machine intended for home use, the cranks and motors are mounted on pedestals secured to a plate. A user may sit in a chair adjacent to or on the plate to conduct arm or leg exercises; or stand between the pedestals to do arm exercises.

Further features and advantages of the machine will be apparent from the following specification and from the drawings.

BRIEF DESCRIPTION OF THE SEVERAL VIEWS OF THE DRAWINGS

FIG. 4C is a perspective of a user in a wheelchair exercising his legs with the ROM machine of FIG. 1;

FIG. 4D is a perspective of a standing user exercising his arms with the ROM machine of FIG. 1;

FIG. 13 is a perspective of a crank arm and crank motor;

FIG. 13A is a longitudinal section of the crank arm along line 13A-13A of FIG. 13, which is offset from the arm axis;

FIG. 13B is a transverse section through the crank arm and its coupling with the crank motor;

FIG. 14 illustrates one example of a user control;

FIG. 16 is a perspective of a further embodiment of the ROM machine for leg exercise;

FIGS. 16A and 16B are diagrammatic side views of the ROM machine of FIG. 16 illustrating the range of motion of the machine;

FIG. 18 is a perspective of another embodiment of the ROM machine for arm exercise;

FIG. 19 is a perspective of the ROM machine of FIG. 18 for leg exercise;

FIG. 19A is a diagrammatic side view of the ROM machine of FIG. 19 with a chair for the user;

DETAILED DESCRIPTION OF THE INVENTION

Figure 1:
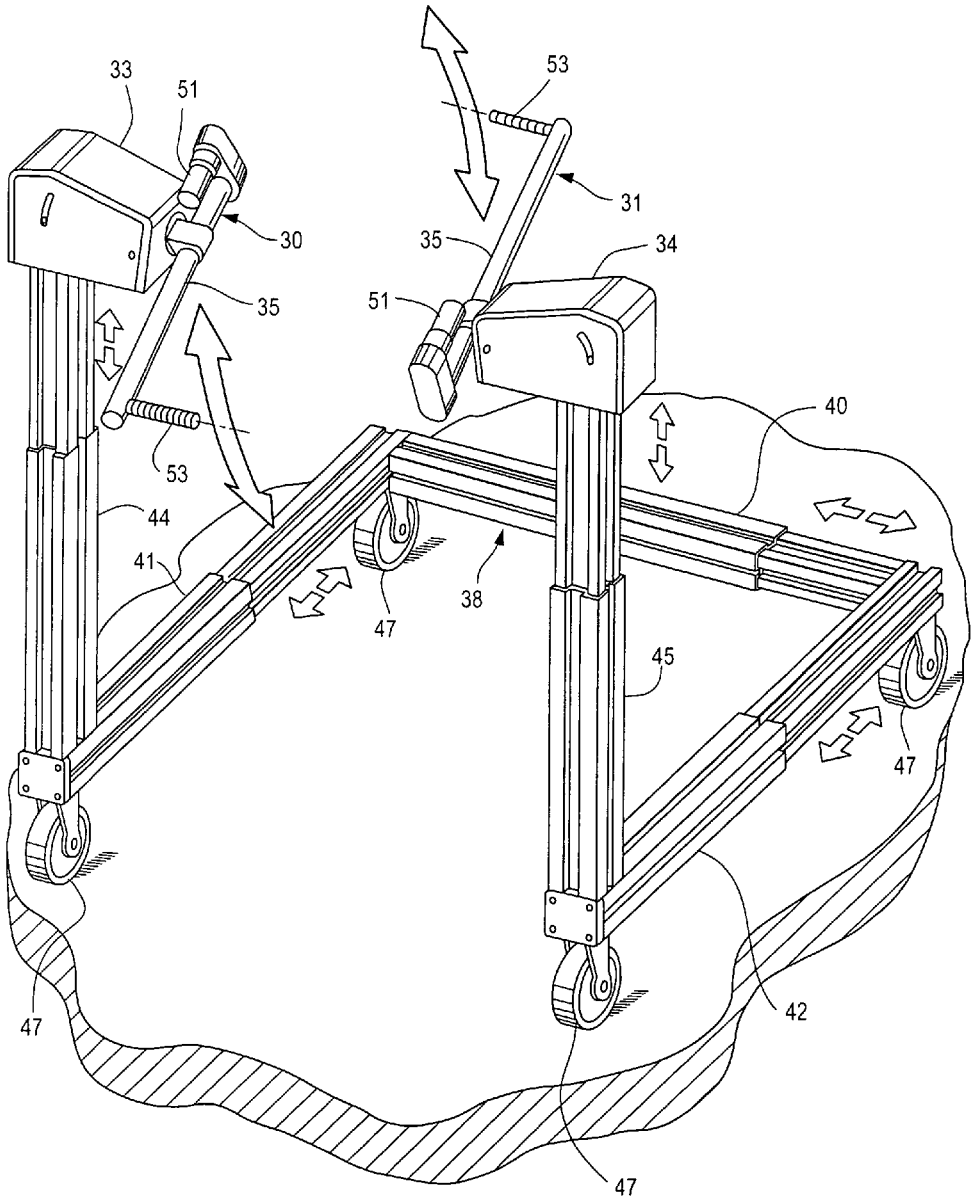
FIG. 1 is a perspective of an embodiment of the ROM machine.

A first embodiment of the ROM machine particularly suited for use in a hospital or rehabilitation facility where the user may be confined to bed and in other environments, is shown in FIGS. 1-5B. A pair of opposed cranks 30, 31 are directly driven by separate electric motors, as motor 32, FIGS. 2A, 2B in housings 33, 34. The motor speed is adjustable and may, for example, range from barely moving to 40 r.p.m. The motor housing and motor control will be discussed below. The cranks have planes of rotation which define a user location 36 between them, FIGS. 4A, 4B. The user location may, for example, be a hospital bed or a padded bench. A U-shaped frame 38 has a base 40 and legs 41, 42. Pedestals 44, 45, one at the end of each frame leg remote from base 40, have the crank motor housings 33, 34 and cranks 30, 31 mounted at the top. The crank motor housings are sometimes referred to hereafter as crank heads. The frame 38 has swiveled, locking caster wheels 47 and may readily be moved from user to user. Each of the frame elements 40, 41, 42 and pedestals 44, 45 is adjustable in length, as by an electronically controlled motor drive (not shown) to accommodate users of different size and different exercises. The frame elements and pedestals are telescopic columns available from SKF USA, Inc., Norristown, Pa., under the trademark TELEMAG. Arrows in the drawings indicate adjustment of the length of elements and rotation of the cranks.

Cranks 30, 31 are driven directly by their motors without the interposition of chains, belts, or exposed gears. One motor acts as a master motor and the other follows it, as a slave, with a 180° displacement, as will be described below. The length of each crank arm 35 may be adjusted independently, whether the cranks are stopped or rotating, by motor 51 also as described below. The cranks rotate in synchronism, with the 180° displacement as shown, and the direction, speed of rotation and crank arm length may be selected adjusted electronically by the user, by an attendant or operator or programmed by computer control, not shown. Additionally the crank heads may be rotated manually about either a horizontal or vertical axis, while the unit is static, to provide arm and torso movement of the user, similar to a swimming stroke. The cranks 30, 31 are fitted with interchangeable handgrips 53 or foot pedals 55 to exercise the arms, shoulders and upper torso or the legs and hips. The foot pedal 55 is provided with straps 56, FIG. 3, to secure the user's foot to the crank. The many handgrips and foot pedals available cover a wide range and variety to include strapping in a hand or foot when required.

The ROM machine is usable by a stroke or paralysis patient to maintain movement of the arms and legs and by anyone to build strength and/or extend range of movement.

The ROM machine of FIG. 1 may be operated from either the open end or the closed end of frame 38. The user can stand, sit in a chair or lie on a bed. Adjustment of the length of the frame elements 40, 41, 42 and the height of the pedestals 44, 45 enables arm or leg exercise and accommodates user size and position. Selection of the angle of the planes of crank rotation affords different exercises of the arms and torso.

The versatile machine of FIG. 1 can be used in many ways. Examples are shown in FIGS. 4A, 4B, 4C, 4D, 5A, and 5B. A user seated in a wheelchair 60 exercises his legs in FIG. 4C. The user in the wheelchair is positioned as shown and the wheelchair locked. The planes of rotation of the cranks 30, 31 are vertical and parallel. The length of frame base 40 is adjusted to match the width of the user's legs. The pedestals 44, 45 are at a relatively low position to match the height of the user's legs.

If the user in the wheelchair wished to exercise arms and upper body, pedestals 44 and 45 would be raised so the heads are horizontal to the shoulders, extend from base 40 and turn the heads toward his body about a vertical axis. All adjustments are done electronically with the exception of turning the heads toward the body.

A standing user in FIG. 4D exercises his arms. The height of pedestals 44 (not shown), 45 is adjusted to match the user's height and the length of frame base 40 is adjusted to match the width of the user's shoulders. Cranks 30, 31 may be operated in parallel as shown or the heads may be turned about a vertical axis toward the user. This causes the arms to cross in front of the user's body, as in a swimming stroke that torques and exercises the entire upper body.

Figure 5:
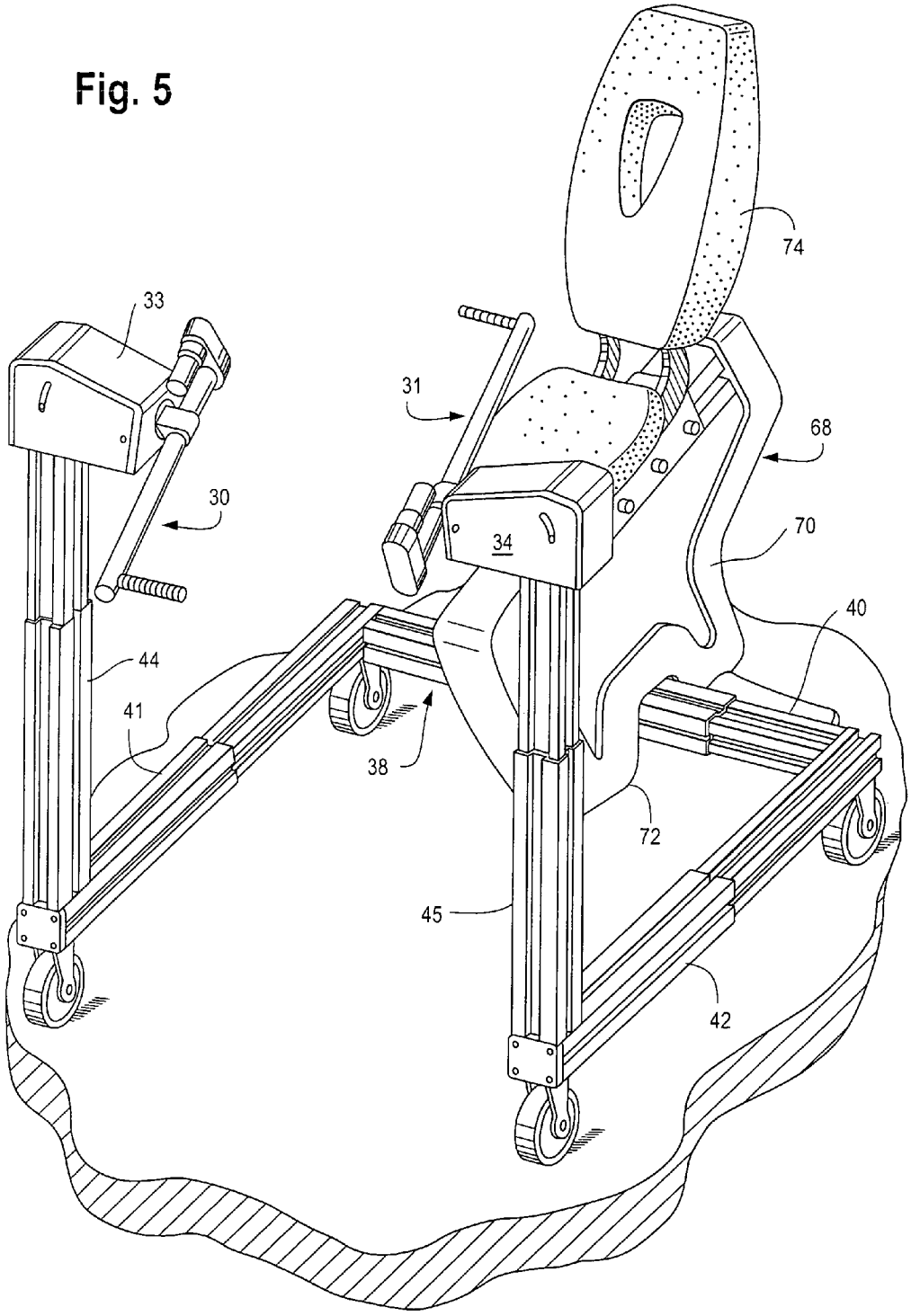
FIG. 5 is a perspective of the ROM machine of FIG. 1 with a user chair positioned over a section of the frame.
Figure 5A:
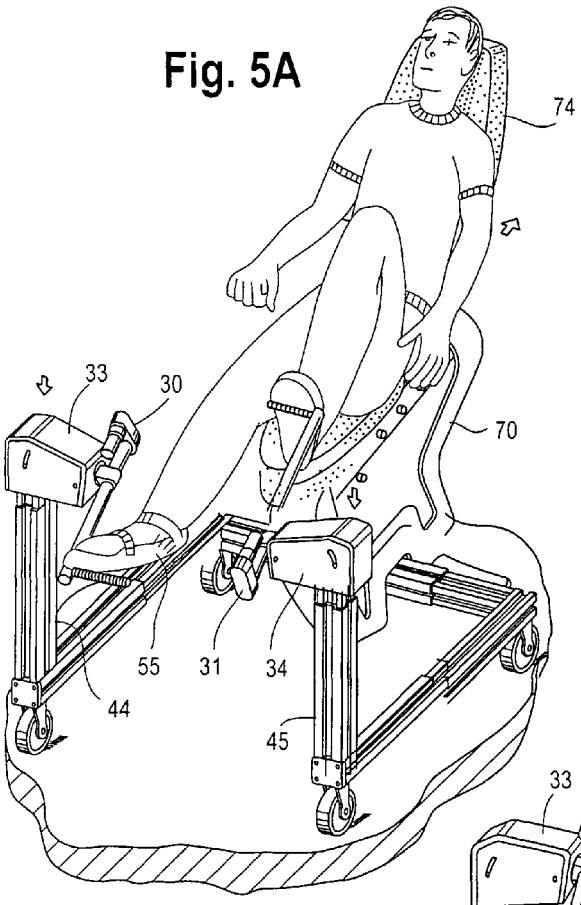
FIG. 5A is a perspective of a user in the chair of FIG. 5 exercising his legs.
Figure 5B:
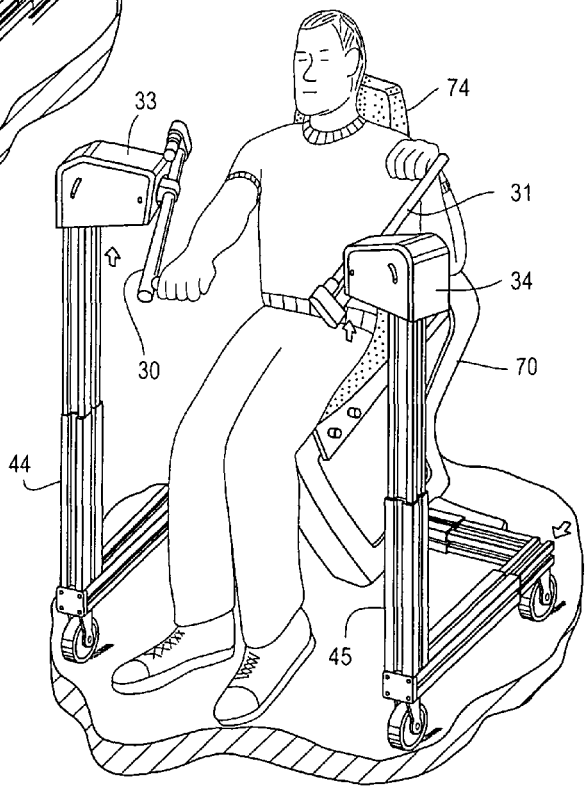
FIG. 5B is a perspective of a user in the chair of FIG. 5 exercising his arms.

Other uses of the frame-mounted cranks are illustrated in FIGS. 5, 5A and 5B. A chair 68 has a base 70 with a central recess 72 positioned over base element 40 of the frame 38, connecting the chair with the cranks 30, 31. The chair seat and back 74 is slidable on inclined base 70 to position the user with respect to the cranks. In FIG. 5A, the pedestals 44, 45 are lowered and the chair seat 74 moved rearwardly and upwardly on base 70 for leg exercise. For arm exercise, FIG. 5B, the seat 74 is moved forward and lower, the pedestals 44, 45 raised, frame legs 41, 42 shortened, frame base 40 widened and the plane of crank rotation angled toward user about a vertical axis.

Further details of the crank and crank motor mounting in the crank head, adjustment of the plane of crank rotation about horizontal and vertical axes and control of the length of crank arm 35 are shown in FIGS. 6-13. Cranks 30, 31 and the related crank heads 33, 34 are identical. Only crank 31 and crank head 33 will be described.

Figure 2A:
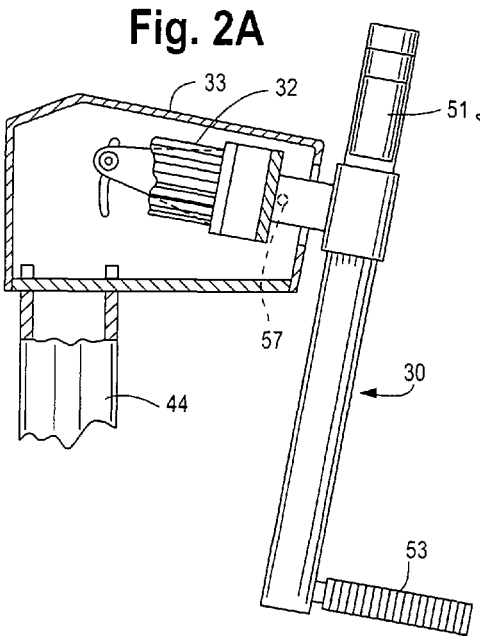
FIGS. 2A and 2B are partial views showing two positions of the cranks with hand grips.
Figure 2B:
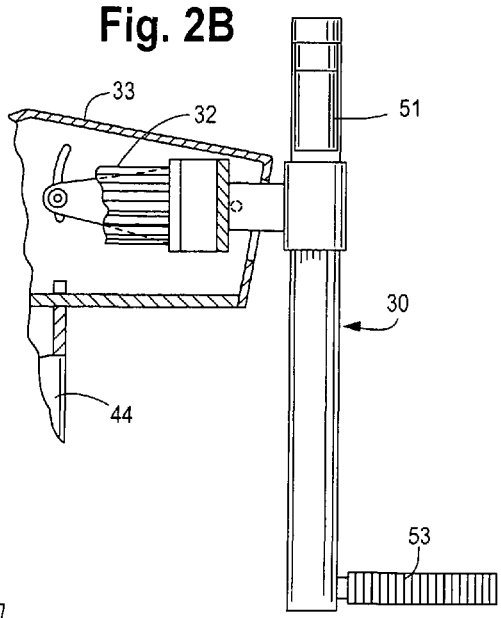
Figure 3:
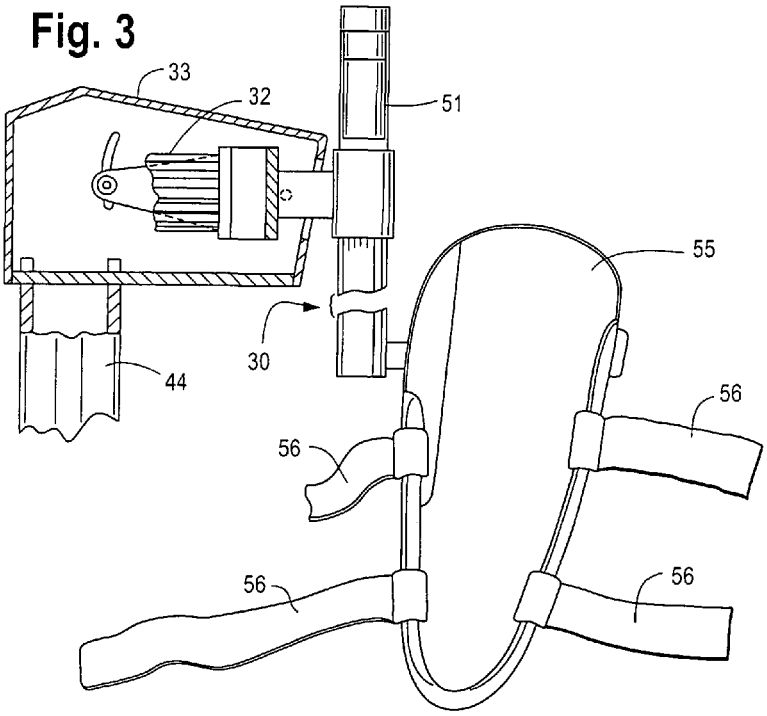
FIG. 3 is a fragmentary view of a crank with a foot pedal.
Figure 4A:
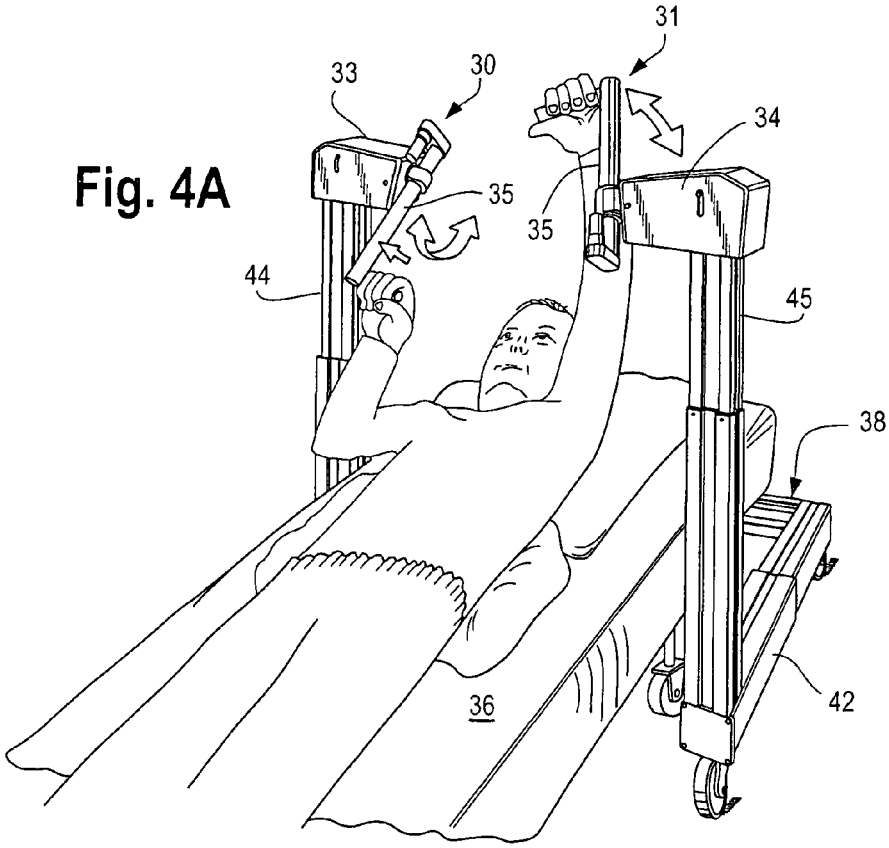
FIG. 4A is a fragmentary perspective of a user lying on a bed exercising his arms with the ROM machine of FIG. 1.
Figure 4B:
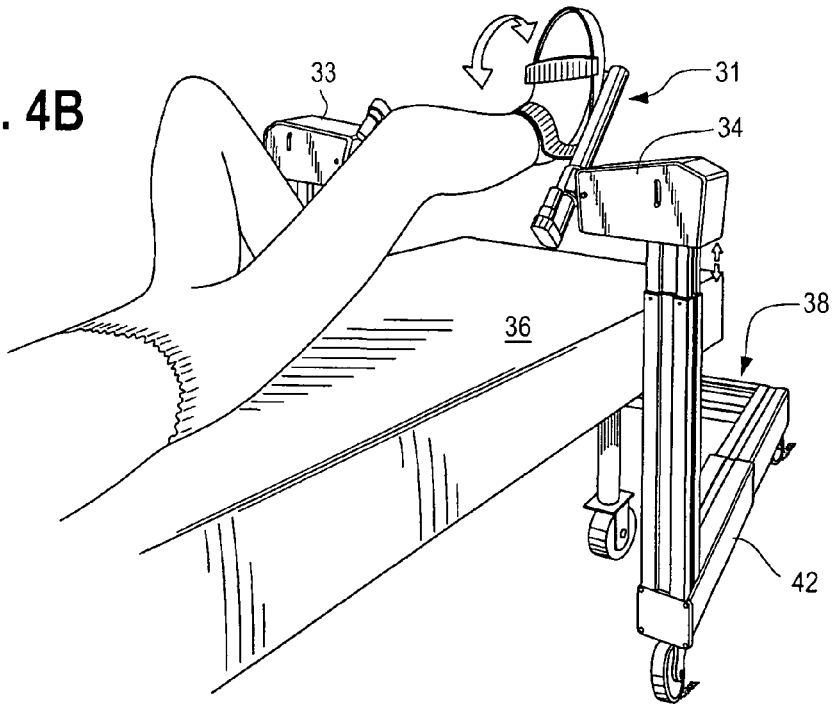
FIG. 4B is a perspective of a user lying on a bed exercising his legs with the ROM machine of FIG. 1.
Figures 6, 7, 8, 9, 10, 11, 12:
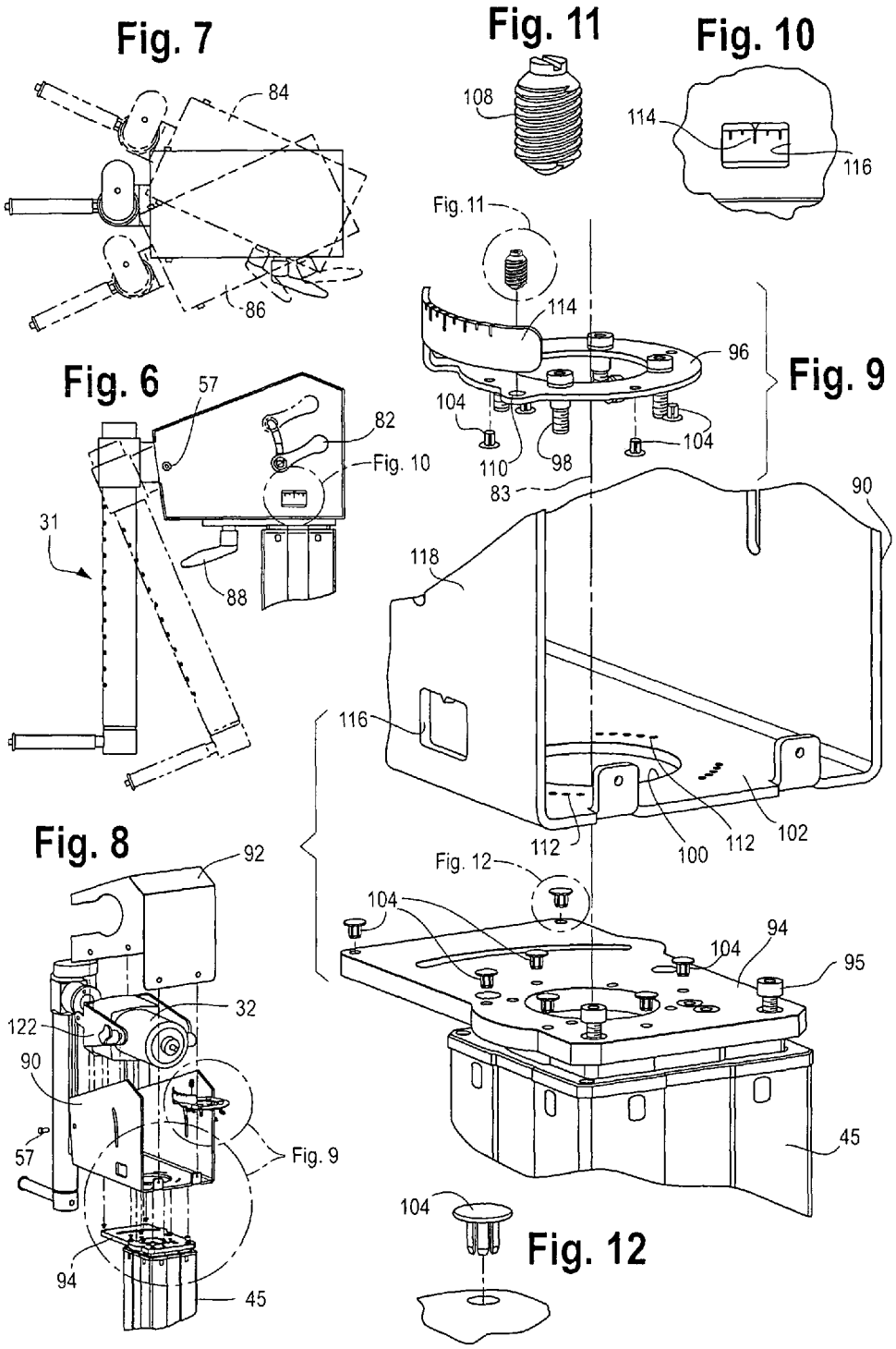
FIG. 6 is a fragmentary elevation of the crank motor housing at the top of a pedestal, showing variation of the plane of rotation of the crank about a horizontal axis.
FIG. 7 is a plan view of the crank motor housing of FIG. 6 showing variation of the plane of rotation of the crank about a vertical axis.
FIG. 8 is an exploded perspective of the crank motor housing and crank motor mounting on a pedestal.
FIG. 9 is an enlarged, exploded perspective of a portion of the housing and crank motor mounting as indicated in FIG. 8.
FIG. 10 is an enlarged detail, as indicated in FIG. 6, of a scale indicating the angle of the plane of rotation of the crank about a vertical axis as shown in FIG. 7.
FIG. 11 is an enlarged perspective detail as indicated in FIG. 9 of a detent mechanism to locate the plane of rotation of the crank about the vertical axis as shown in FIG. 7.
FIG. 12 is an enlarged perspective detail, as indicated in FIG. 9, of one of the buttons which supports the head for rotation about a vertical axis.

The plane of rotation of crank 31 can be adjusted about a horizontal axis established by pins 57 (one shown in FIGS. 6 and 8), for rotation either in a vertical plane as shown in solid lines in FIG. 6 and in FIGS. 2*b*, 3, 4B and 4C or in a plane displaced from vertical as shown in FIGS. 2A, 4A, 4D and in broken lines in FIG. 6. As noted above, this adjustment is needed only for a user on a bed or table exercising arms. A displacement angle of the order of 25° has been found suitable. Clamp 82 secures the crank head 31 in the desired position.

Crank head 34 with crank 31 can be adjusted horizontally about a vertical axis 83, FIG. 9, between positions indicated in broken lines at 84 and 86, FIG. 7, displaced 25° on either side of the solid line position. Clamp 88, FIG. 6, secures the head in the desired position. Adjustment of the crank head to one of the broken line positions of FIG. 7 affords selection of rotation of the user's torso while conducting arm exercise, FIGS. 4A, 4D and 5B, and allows a user to conduct arm exercise from either side of the pedestals.

The crank head 34 comprises a housing 90 with a cover 92, FIG. 8. Base plate 94 is secured to the top of pedestal 45 by screws 95, FIG. 9. Housing 90 rests on base plate 94 and is held in position by retaining ring 96 which is secured to the base plate by shouldered machine screws 98 which extend through opening 100 in panel 102 of housing 90. The shoulders of screws 98 engage the edge of opening 100 to position housing 90. Plastic bearing buttons 104 inserted in the upper surface of base plate 94 and the undersurface of retaining ring 96 allow rotation of housing 90 on pedestal 45 about vertical axis 83. Ball detent 108, FIG. 11, mounted in retainer ring 96 at opening 110 cooperates with recesses 112 in the floor 102 of housing 90 to position the housing at angular increments about vertical axis 83. Scale 114 on retaining ring 96 is visible through opening 116 in sidewall 118 of housing 90, indicating the angle of the plane of rotation of crank 31 about vertical axis 83.

Crank motor 32 is mounted in a cradle 122, FIG. 8, secured in housing 70 by pins 57 (one shown) which establish the horizontal axis about which the plane of rotation of crank 31 may be adjusted. Crank 31 is connected directly to motor 32 without gears, chains, or belts.

The mounting of the crank 30 and the mechanism for adjustment of the length of crank arm 35 are shown in FIGS. 13, 13A and 13B. Crank motor 32 has an output shaft (not shown) to which the shaft portion 130 of a knuckle 132 is connected. Crank arm 35, a cylindrical tube, is slidably received in a sleeve portion 134 of knuckle 132. Motor mount 136 at the end of the crank tube 31 supports DC crank length motor 51 and drive screw 140 which extend longitudinally inside crank arm tube 35. Toothed pulleys 142, 144 are connected with motor 51 and drive screw 140, respectively, and are joined by a toothed drive belt 146. A nut 148 threaded on screw 140 extends outwardly through a longitudinal slot 150 in crank arm tube 35 and is connected through knuckle shaft portion 130 with the end of the shaft (not shown) of crank motor 32. Rotation of the screw 140 by motor 51 moves the crank arm tube 35 longitudinally with respect to nut 148 and knuckle 132 increasing or decreasing the effective crank arm length.

Electrical power for DC motor 51 is connected from a source (not shown in FIG. 13B) through a slip disk 150 to conductors 151 which pass through an opening 148*a* in nut 148 to brushes (not shown) inside insulators 152 and 154 on the nut. Conductive rods 160, 162 extend the length of crank tube 31 and are supported between insulators 164, 166 in motor mount 136 and insulators 168, 170 in crank end piece 172 and are electrically connected with DC motor 51 by conductors (not shown) in motor mount 136. The rods pass through insulators 152, 154 and engage the brushes (not shown) which deliver DC power for motor 51. The polarity of the power determines the direction of rotation of motor 51 and whether the crank 31 is lengthened or shortened.

In a typical exercise session, the user will start with a short crank length and a slow crank rotation speed. As the user's muscles are warmed and stretched, crank length and rotation speed are increased. The length of each crank 30, 31 may be separately adjusted to accommodate physical limitations of the user. Crank length may be changed whether the cranks are rotating or stationary. A scale 174 on crank arm tube 35 indicates the effective crank length.

The direction and speed of rotation of cranks 30, 31 and the crank length or arc size are selected at a control panel 175, FIG. 14. Switches 176*a*, 176*b*, 177*a*, and 177*b* control the length of the arms of cranks 31 and 30, respectively. Switches 178, 179 raise and lower pedestals 44, 45. Other controls and displays of control panel 175 will be described below. Control panel 175 may be wired to suitable power sources and other elements of the crank controls or connected wirelessly. FIG. 14 is an example. The control panel will vary for different embodiments and may include other controls and displays.

Figure 15:
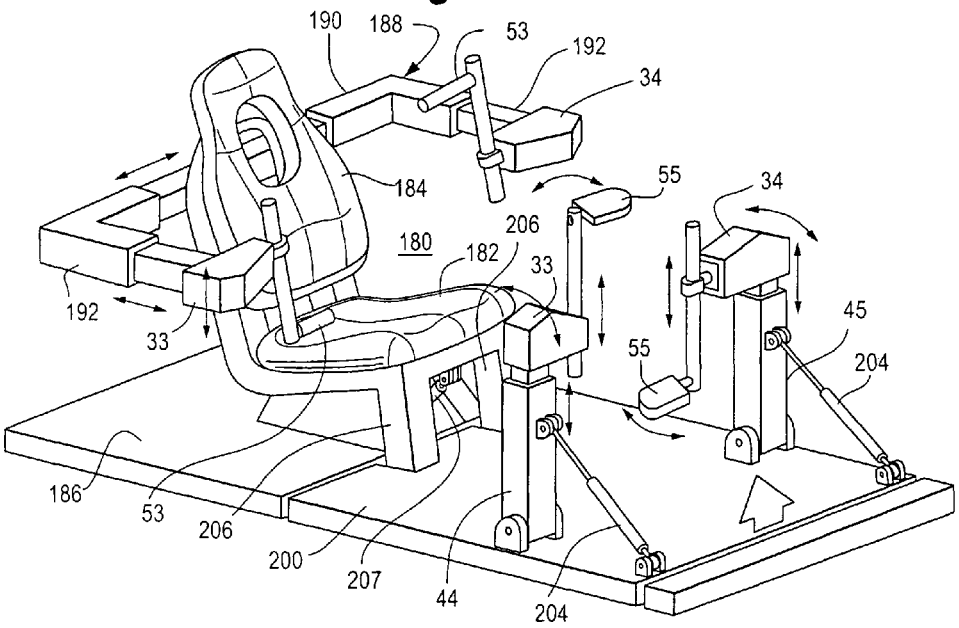
FIG. 15 is a perspective of another embodiment of the ROM machine.
Figure 15A:
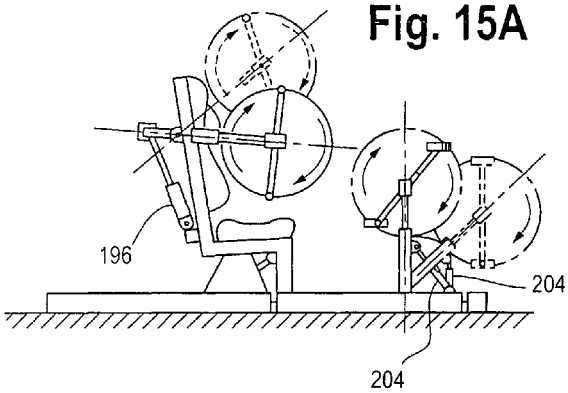
FIGS. 15A and 15B are diagrammatic side views of the ROM machine of FIG. 15 illustrating the range of motion of the machine.
Figure 15B:
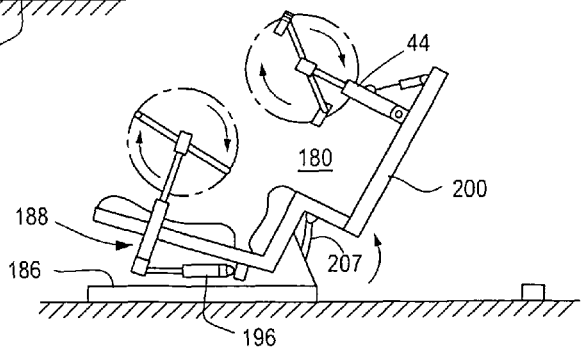

The crank head 34 of FIGS. 1-5B and 6-12 may be used with other embodiments of the machine. The ROM machine shown in FIGS. 15-15B provides for exercise of both arms and legs at the same time. This machine is suitable for a rehabilitation facility, gymnasium or a home exercise installation. A chair 180 with a seat 182 and back 184 is mounted to tilt on a plate or base 186. The chair may be provided with a seat belt (not shown. A U-shaped yoke 188 has an adjustable length base 190 pivoted to the chair back 184 and adjustable length legs 192, terminating in opposed crank heads 33, 34, each comprising a motor and crank fitted with a hand grip 53 for arm exercise. The two heads 33, 34 will rotate on vertical axis 83 as in FIG. 7 to give the swimming motion. The length of yoke base 190 can be shortened or lengthened to bring the crank heads closer together or moved further apart to accommodate different sized users. The angle of yoke 188 with respect to chair 180 is adjusted by actuator 196, as an electric actuator. The length of yoke legs 192 is adjusted to accommodate the user's body size. Plate or base 200 in front of chair 180 supports adjustable height pedestals 44, 45 with crank heads 33, 34 and opposed cranks. The cranks are fitted with any of various foot pedals 55 for leg exercise. Pedestals 44, 45 are pivoted to plate 200 and positioned by actuators 204 to control the distance from chair 180 and accommodate the length of the user's legs. Plate 200 is fixed to chair legs 206 and is lifted when the chair is tilted by actuator 207 to the supine position as shown in FIG. 15B. The extreme positions of the actuators 196 and 204 and the cranks are indicated in FIG. 15A.

Rotation of the hand grips 53 and foot pedals 55 is electronically synchronized so that the arms and legs are moved at the same speed, in the same direction, and with 180° displacement between the right arm and right leg and between the left arm and left leg. The right arm and left leg are extended at the same time as are the left arm and right leg. One crank motor serves as a master and the other three operate as slaves. While this machine is primarily designed to move all four limbs at the same time, it does allow for use of arms or legs separate of the other. To accommodate this, one of the three motors previously operated as a slave takes a turn as a master.

Figure 17:
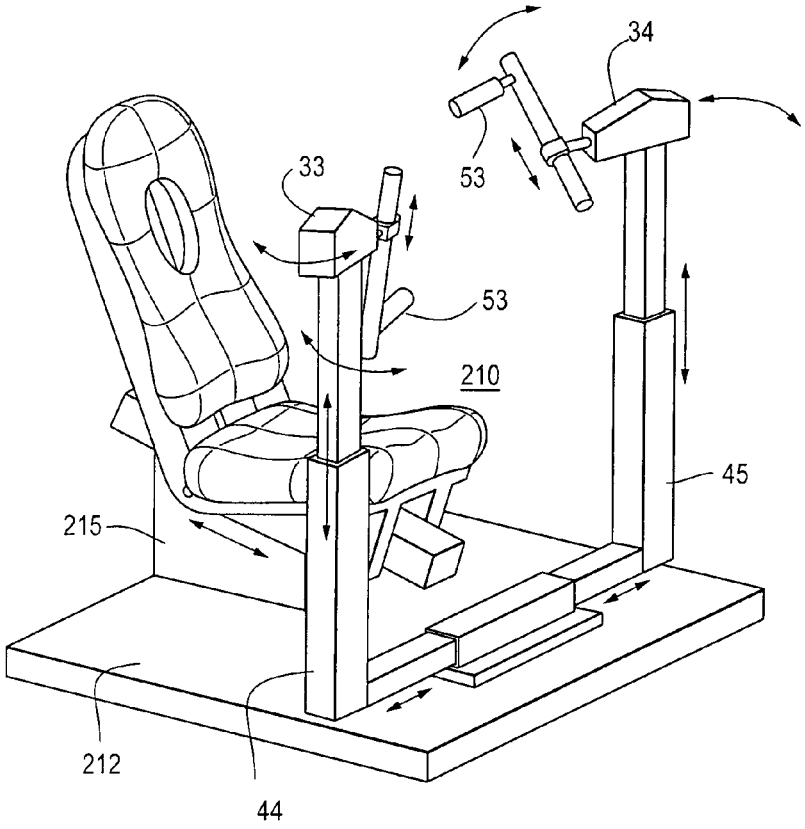
FIG. 17 is a perspective of another embodiment of the ROM machine for arm exercise.
Figure 17A:
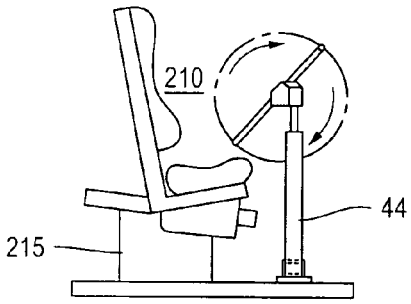
FIGS. 17A and 17B are diagrammatic side views of the ROM machine of FIG. 17 illustrating the range of motion of the machine.
Figure 17B:
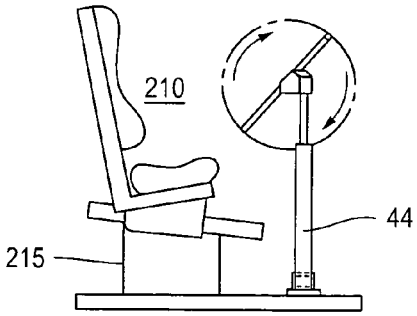

The embodiments of FIGS. 16-17B show a chair 210 on a plate 212 adjacent adjustable height pedestals 44, 45, each having a crank head 33, 34 at the top. The two units are intended to be set side-by-side in a gymnasium, for example. The chair 210 is mounted to slide on an inclined base 215 to adjust both the space between the chair and pedestals 214 and the height of the chair. In FIG. 16, the cranks are fitted with foot pedals 55 for leg exercise; and in FIG. 17, the cranks are fitted with hand grips 53 for arm exercise. The chair 210 in FIG. 17 is closer to pedestals 214 than in FIG. 16. The diagrams of FIGS. 16A, 16B, and 17A, 17B illustrate the range of relative positions of chair 210 with respect to the cranks. The movable chair 210 and adjustable height pedestals accommodate users of different size. The lateral spacing of pedestals 44, 45 in FIG. 17 can be adjusted to accommodate the user's size. The position of the crank heads 33, 34 in FIG.

17 can be adjusted about vertical axes to achieve the desired swimming motion, arm extension and body rotation.

FIGS. 18 and 19 show yet another embodiment of an apparatus using crank heads 33, 34 on adjustable height pedestals 44, 45 mounted on a plate 222. The cranks in FIG. 18 have hand grips 53. The cranks of FIG. 19 have foot pedals 55. The user of the arm exercise apparatus of FIG. 18 may be seated next to platform 222 between pedestals 44, 45 and the pedestals position the crank heads 34 in front of the user's upper body. The user of the leg exercise apparatus of FIG. 19, may, for example, sit in a chair 228 adjacent mounting plate 222 as indicated in the diagram of FIG. 19A and the pedestals position the crank heads 33, 34 in front of the user's lower body. These units are less expensive than those of the other embodiments and are suitable for home use.

Crank Controls

The pair of motors which turn cranks 30, 31, FIG. 1, and comparable cranks in FIGS. 16, 17, 18 and 19, and their control will be described with reference to the processor flow charts of FIGS. 20 and 21 and the block diagram of FIG. 22. In each pair of motors, one motor is designated a master motor 240 and the other a slave motor 242. The motors are three-phase servo motors and have associated master and slave drives 244 and 246. The motor drives 244, 246 are powered by a 24 volt DC power supply 248 which may be connected with a 110 volt AC source. Alternatively, the drives may be powered by a 24 volt battery, not shown. Each drive comprises a three-phase inverter 250 providing three-phase voltage to the associated motor and a processor 252 which controls the inverter 250 in response to input signals from the motors at 254 and 256 and other inputs and a processor program to be described. The inverter and processor of slave drive 246 are not indicated in the drawing. The phase sequence from inverter 250 determines the direction of rotation of the motor and crank and the frequency of the signal from the inverter establishes the motor and crank speed. A tracking signal 258 from the master drive to the slave drive causes the slave motor 242 to rotate in the same direction and at the same speed as master motor 240. Suitable motors and drives are Elmo Cello motors and controls from Elmo Motion Control, Inc., Nashua, N.H.

Motors 240, 242 and their cranks are free to rotate independently when the crank motor drives 244, 246 are not powered. When power is applied, as by connecting the power supply 248 with a power source, it is necessary to establish the 180° out of phase relationship between the cranks. Each motor/crank arm has an index rings 260, 262 mounted to rotate with the mechanical connection (not shown) between the motor and crank. Each ring has an index position 260*a*, 262*a*. The index rings 260, 262 are conductive and connected with the 24 volt supply 248. Index positions 260*a*, 262*a* are non-conductive so that signals are provided to master drive processor 252 when each crank is at its index position. Establishment of the 180° phase relationship of the cranks is controlled by the software of FIG. 20 for the master drive processor 252.

Figure 20:
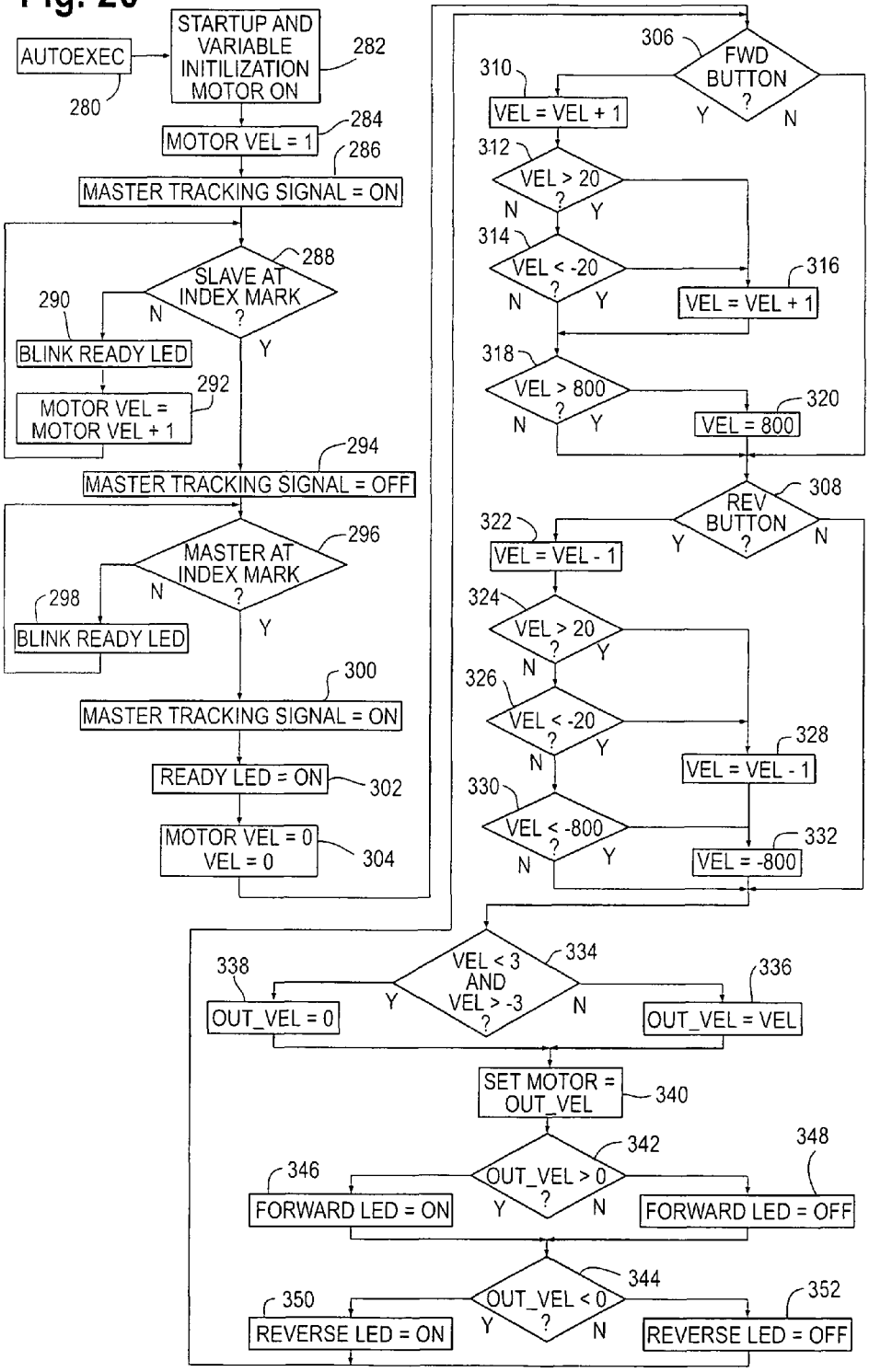
FIG. 20 is a flow chart of a processor program for starting and operating the crank motors.

On startup, the master drive begins operation at Autoexec block 280, FIG. 20. Master motor 240 is turned on at block 282 and motor velocity is set at one increment, block 284. Master tracking signal 258 is turned on at block 286 causing slave motor 242 to rotate in synchronism with master motor 240. Decision block 288 determines whether slave motor index washer 262 is at the index mark 262*a*. If it is not, ready LED 264 on the control panel 175 blinks, block 290. At block 292, the motor velocity is increased one speed increment and the program returns to decision block 288. The motors 240, 242 start at a low speed for safety and the speed increase minimizes the time required to move the motors and cranks to the desired 180° positions. When the decision block 288 determines that slave motor 242 is at its index position 262*a* master tracking signal 258 is turned off at block 294, rotation of the slave motor stops, and the decision block 296 determines whether master motor 240 is at its index position. If it is not, ready LED 264 continues to blink, block 298, and the master motor 240 continues to rotate until it reaches the index position. At that point, tracking signal 258 is turned on at block 300, ready LED 264 is turned on at block 302, and the motor velocity is set to zero at block 304. The four-crank machine of FIGS. 15, 15A and 15B has one master motor and three slave motors.

The direction and velocity of the crank motors rotation is controlled by the Forward 268 and Reverse 270 buttons which act through the master drive processor 252 in accordance with the program of FIG. 20. The forward direction is clockwise rotation of the crank 31 on the user's left and counterclockwise rotation of crank 30 on the user's right, for a user as shown in FIG. 4A. If the cranks are rotating in the forward direction, actuation of the Reverse button 270 causes the motors to slow, stop, and then reverse direction. Details of the control will appear from the following description of the program flow chart in FIG. 20.

Decision blocks 306 and 308 determine whether the Forward button 268 or the Reverse button 270 is actuated. Assuming actuation of the Forward button, velocity is set at existing velocity plus one velocity unit at block 310. If the velocity is in excess of plus or minus twenty units at decision blocks 312, 314, the actual velocity is incremented by one unit at block 316. Decision block 318 sets a maximum velocity of 800 units at block 320. Similarly, if Reverse button 270 instead of Forward button 268 is actuated, decision block 308 directs reduction of the velocity (or an increase of reverse velocity) at block 322. If the velocity is greater than 20 units in either direction, decision blocks 324, 326 direct a change of velocity of one unit at block 328. If the velocity exceeds minus 800 units at decision block 330, the velocity is set at minus 800 units, block 332. If the velocity exceeds three units in either direction, decision block 334 sets the velocity at block 336. If, the velocity is between plus or minus three units at decision block 334, block 338 sets output velocity at zero. The software responds to the Forward and Reverse buttons 268 and 270 more rapidly than a user can accurately react. Accordingly, if velocity is almost zero, the motors are stopped. Block 340 sets the motor speed at the output velocity. Decision blocks 342 and 344 determine whether the output velocity is greater or less than zero and control energization of the forward and reverse LEDs 272, 274 at blocks 346, 348, 350, and 352.

Figure 21:
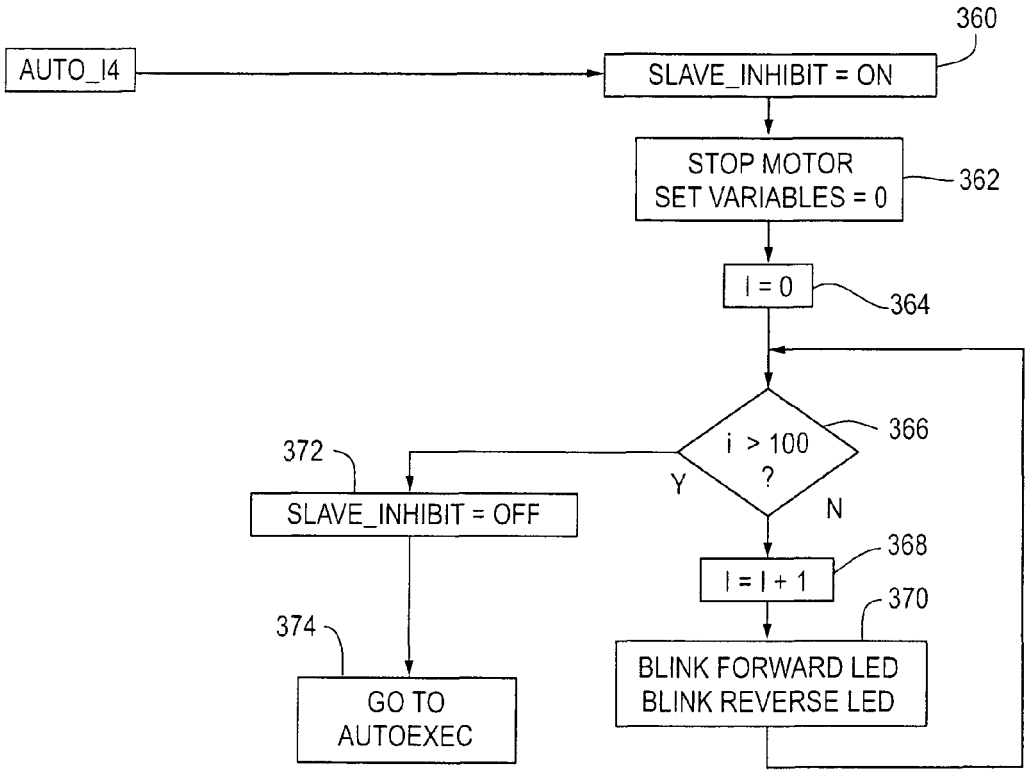
FIG. 21 is a flow chart of a processor program for stopping the crank motors.
Figure 22:
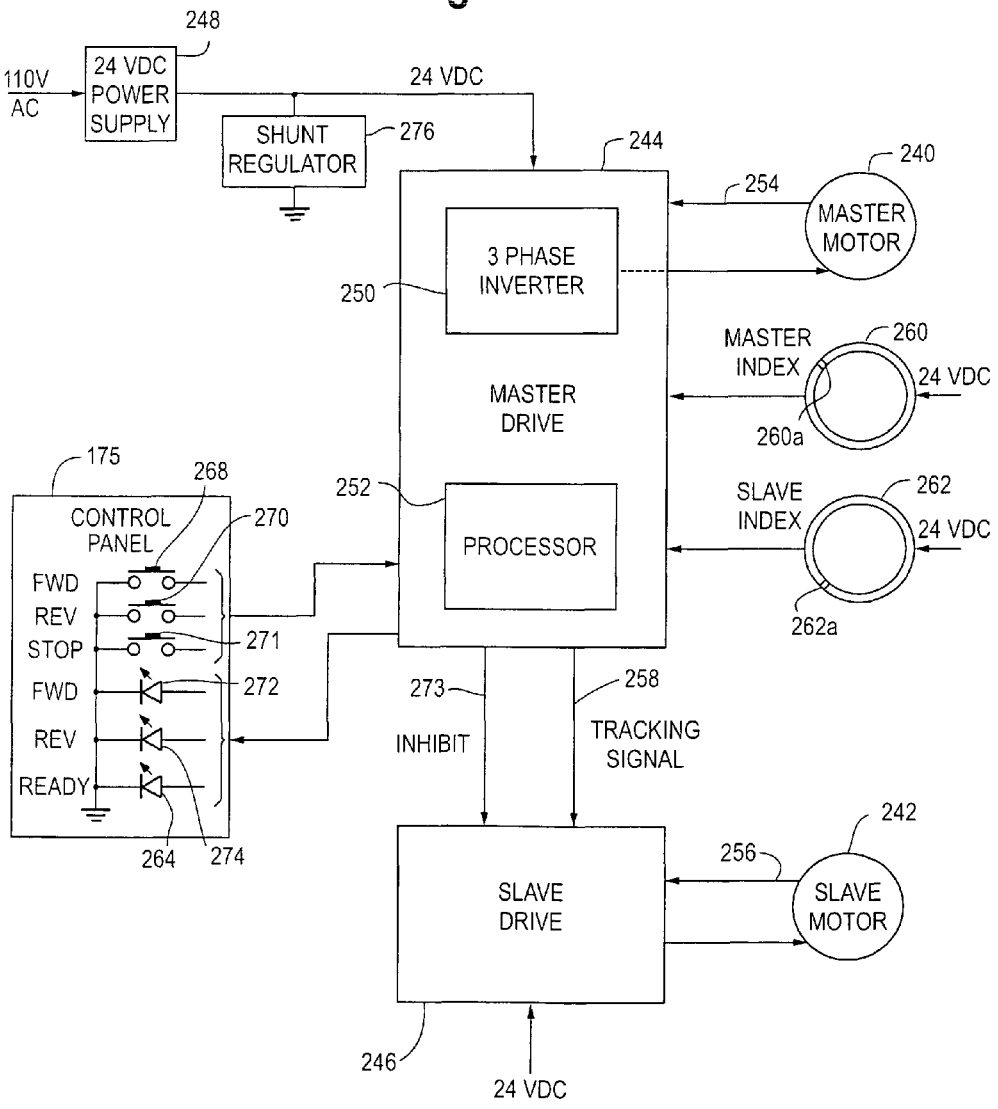
FIG. 22 is a simplified block diagram of the crank motor control circuit.

Should a user need to stop the ROM machine quickly, as in an emergency, pressing the STOP button 271 initiates the program of FIG. 21 at AUTO_I4. The slave drive inhibit signal 272=3 is turned on at block 360 removing power from slave motor 242 and allowing it to turn freely. Master motor 240 is stopped at block 362 and the variables are set to zero. Both cranks can then be freely turned so that the user can leave the machine if desired. A timer is set to zero at block 364. Decision block 366 and time addition block 368 form a time delay loop. Block 370 causes Forward and Reverse LEDs 272, 274 to blink. When the time delay ends, block 372 turns off the slave inhibit signal and block 374 returns the program to the start-up function at block 280. The master and slave motors and cranks are then resynchronized and the machine is ready for use.

A user may work the machine in the direction of rotation of the crank motors 240, 242. This causes the drives 244, 246 to act as generators delivering energy to power supply 248 and causing the DC voltage to rise. Shunt regulator 276 acts as a sink for excess power to prevent the power supply 248 from shutting down.

Because these ROM machines are the first to be operated by electronics and do not have chains, belts or gears it is much easier to gather very valuable information about all phases of movement. Therefore, these machines may be equipped with computers that gather and transmit this information to the user, therapist or insurance company.

The invention claimed is:

1. A ROM machine, comprising:

a support;

two spaced apart pedestals extending upwardly from said support;

two motor-driven, opposed cranks, one at the upper end of each pedestal, each crank having a plane of rotation, the cranks defining a user location between the planes of rotation, wherein said support is a U-shaped frame having two legs joined by a base, each leg having an end remote from said frame base, with said two pedestals extending upwardly, one from said end of each frame leg remote from said frame base.

2. The machine of claim 1 in which said support is a plate.

3. The machine of claim 1, further comprising:

hand grips and foot pedals interchangeably connectable with said cranks.

4. The machine of claim 1 further comprising wheels on said frame for ease of movement.

5. The machine of claim 1 wherein each of said frame legs and said frame base is adjustable in length.

6. The machine of claim 1 wherein each of said pedestals is adjustable in height.

7. A ROM machine, comprising:

a support;

two spaced apart pedestals extending upwardly from said support;

two motor-driven, opposed cranks, one at the upper end of each pedestal, each crank having a plane of rotation, the cranks defining a user location between the planes of rotation; and a crank head at the top of each pedestal, the head housing the motor, with each crank being outside said head and connected directly with the associated motor.

8. The machine of claim 7 in which each motor and crank is mounted for adjustment about a horizontal axis in its head, the horizontal axes being parallel with the planes of rotation of the cranks, between first positions with the planes of rotation parallel and second positions with the planes of rotation diverging along the user location.

9. The machine of claim 7 in which each said head is mounted on said pedestal for rotation about a vertical axis in said head.

10. The machine of claim 7 in which each motor and crank is mounted for adjustment about a horizontal axis in its head, the horizontal axes being parallel with the planes of rotation of the cranks, between first positions with the planes of rotation parallel and second positions with the planes of rotation diverging along the user location.

11. The machine of claim 7 in which each motor and crank is mounted for rotation about a vertical axis in its head between first positions with the planes of rotation parallel and second positions with the planes of rotation diverging along the user location.

12. A ROM machine comprising:

a user chair;

a pair of opposed, motor-driven leg cranks with foot pedals mounted to said chair and rotatable in planes laterally spaced from the chair;

a pair of opposed, motor-driven arm cranks with hand grips mounted to said chair and rotatable in planes laterally spaced from the chair;

a base for said chair; and a pivot mounting said chair to said base for movement between upright and supine positions, wherein said base is a first plate, and said chair has a seat pivoted to said first plate, said carrier for said leg cranks comprising:

a second plate fixed to said chair and in front of said seat; and two spaced-apart pedestals extending upwardly from said second plate with said leg cranks mounted at the tops of the pedestals, said second plate being movable with movement of said chair.

13. The machine of claim 12 wherein said pedestals are pivoted to said second plate for movement toward and away from said chair.

14. The machine of claim 12 in which said pedestals are adjustable in height.

15. The machine of claim 12 wherein said pedestals are pivoted to said second plate for movement toward and away from said chair.

16. A ROM machine comprising:

a user chair;

a pair of opposed, motor-driven leg cranks with foot pedals mounted to said chair and rotatable in planes laterally spaced from the chair; and a pair of opposed, motor-driven arm cranks with hand grips mounted to said chair and rotatable in planes laterally spaced from the chair, wherein said chair has a back, the machine further comprising:

a U-shaped frame with a frame base pivoted to the back of the chair and a pair of frame arms extending from the base, the arm cranks being mounted at the ends of said frame arms, remote from the frame base.

17. The machine of claim 16 in which the frame arms are adjustable in length.

18. A ROM machine, comprising:

two spaced, opposed cranks, each crank having a plane of rotation and defining a user location between the planes of rotation; and two electric motors, one connected directly with and to rotate each of said cranks in said planes of rotation, each crank being between its motor and the user location, each crank and motor being mounted for adjustment about a horizontal axis, each horizontal axis being parallel with the plane of rotation of the associated crank, and each crank and motor having a first position with the planes of rotation parallel and a second position with the planes of rotation diverging along the user location.

19. A ROM machine, comprising:

two spaced, opposed cranks, each crank having a plane of rotation and defining a user location between the planes of rotation; and two electric motors, one connected directly with and to rotate each of said cranks in said planes of rotation, each crank being between its motor and the user location, each crank has a crank arm and a motor on each crank, operable to adjust the length of the crank arm.

20. The machine of claim 12 in which said pedestals are adjustable in height.

21. A ROM machine, comprising:

two motor driven, opposed arm cranks, each crank having a plane of rotation, the cranks defining a user location between the planes of rotation; and a mounting for each crank for adjustment about a horizontal axis, the horizontal axes being parallel with the planes of rotation of the cranks, between first positions with the planes of rotation parallel and second positions with the planes of rotation diverging along the user location.

22. A ROM machine, comprising:

two motor driven, opposed arm cranks, each crank having a plane of rotation, the cranks defining a user location between the planes of rotation; and a mounting for each crank for adjustment about a vertical axis, the vertical axes being parallel with the planes of rotation of the cranks, between first positions with the planes of rotation parallel and second positions with the planes of rotation diverging along the user location.

* * * * *